US008444470B2

(12) United States Patent
Gurule

(10) Patent No.: US 8,444,470 B2
(45) **Date of Patent: *May 21, 2013**

(54) MULTI-BALL VIDEO-ROULETTE GAMING SYSTEMS, METHODS AND PROCESSOR-READABLE MEDIA

(75) Inventor: Chris J. Gurule, Henderson, NV (US)

(73) Assignee: Concept Gaming, LLC, Albuquerque, NM (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/223,886

(22) Filed: Sep. 1, 2011

(65) Prior Publication Data

US 2012/0172103 A1 Jul. 5, 2012

Related U.S. Application Data

(63) Continuation-in-part of application No. 13/031,471, filed on Feb. 21, 2011.

(60) Provisional application No. 61/429,823, filed on Jan. 5, 2011.

(51) Int. Cl.
*A63B 71/00* (2006.01)

(52) U.S. Cl.
USPC ..... 463/17; 463/25; 463/30

(58) Field of Classification Search
USPC ..... 463/17, 25, 30
See application file for complete search history.

(56) References Cited

U.S. PATENT DOCUMENTS

| | | | | |
|---|---|---|---|---|
| 5,755,440 | A * | 5/1998 | Sher | 273/142 E |
| 6,224,483 | B1 * | 5/2001 | Mayeroff | 463/20 |
| 6,497,409 | B2 * | 12/2002 | Mathews | 273/142 E |
| 7,669,850 | B1 * | 3/2010 | Miller | 273/143 R |
| 2006/0009274 | A1 * | 1/2006 | Finocchio | 463/17 |
| 2008/0076507 | A1 * | 3/2008 | Wertheimer | 463/17 |
| 2008/0214266 | A1 * | 9/2008 | Phillips et al. | 463/17 |
| 2011/0006477 | A1 * | 1/2011 | Miller et al. | 273/142 R |
| 2011/0059790 | A1 * | 3/2011 | Slomiany et al. | 463/22 |
| 2011/0092270 | A1 * | 4/2011 | Jarvis et al. | 463/20 |
| 2012/0122545 | A1 * | 5/2012 | Watkins et al. | 463/20 |

* cited by examiner

*Primary Examiner* — Arthur O. Hall
*Assistant Examiner* — Steve Rowland
(74) *Attorney, Agent, or Firm* — Kermit D. Lopez; Luis M. Ortiz; Ortiz & Lopez, PLLC

(57) ABSTRACT

A video-based multi-ball super-roulette gaming system, method and processor-readable media includes a main/primary roulette wheel having a number of ball pockets with betting marks and a circular runway for rotating multiple graphical game balls within the primary roulette wheel. The system permits a player to pay and play multiple balls in order to maximize the action and winning chances with respect to a player. Multiple balls of the game provide increased action for the player while enticing the player to wager more creating increased gaming volume for an operator. Optionally, a secondary multiplier bonus wheel rotates within the vicinity of the primary roulette wheel in order to provide multiplied potential win for the player when configured with, for example, a bonus-wheel super-roulette gaming system and/or method.

25 Claims, 10 Drawing Sheets

MULTI-BALL VIDEO-ROULETTE GAMING SYSTEMS, METHODS AND PROCESSOR-READABLE MEDIA

CROSS-REFERENCE TO PATENT APPLICATION

This patent application is a Continuation-in-Part of U.S. patent application Ser. No. 13/031,471 entitled "Bonus Wheel Super-Roulette Gaming System and Method," which was filed on Feb. 21, 2011 and which claims priority to U.S. Provisional Patent Application Ser. No. 61/429,823, which was filed on Jan. 5, 2011, the disclosures each of which are incorporated herein by reference in their entirety.

TECHNICAL FIELD

Embodiments are generally related to electronic gaming systems and methods. Embodiments are additionally related to the game of roulette. Embodiments are further related to video-based roulette.

BACKGROUND OF THE INVENTION

Roulette is a well-established casino game of chance having a horizontal wheel, a roulette ball and a betting table. The horizontal wheel generally includes one or more numbered pockets around its periphery mounted at the bottom of a bowl shaped housing and adapted to rotate about a vertical axis. The numbers with respect to each pocket in the horizontal wheel is typically displayed with a color such as, for example, black or red color based on the background on which the number is marked. A video-based casino game roulette played via a stand-alone gaming machine and/or a community-type gaming machine can generate a video simulation of the betting table, the horizontal wheel and the game ball at an electronic display screen.

A conventional roulette wheel generally includes thirty-eight numbered pockets having numbers "0," "00," and 1-36. A winning number/color/number type etc. is chosen by the game ball randomly coming to rest in one of the wheel's pockets. A winning bet occurs when the player's selection/bet/wager includes the winning number/color/number type etc as selected at random by the wheel and ball selection process.

It is believed that a need exists for an improved roulette gaming system. A need also exists for an improved video-based multi-ball super-roulette gaming system, as described in greater detail herein.

BRIEF SUMMARY

The following summary is provided to facilitate an understanding of some of the innovative features unique to the disclosed embodiment and is not intended to be a full description. A full appreciation of the various aspects of the embodiments disclosed herein can be gained by taking the entire specification, claims, drawings, and abstract as a whole.

It is, therefore, one aspect of the disclosed embodiments to provide for an improved casino gaming system and method.

It is another aspect of the disclosed embodiment to provide for an improved video-based roulette wheel gaming system and method.

It is further aspect of the disclosed embodiments to provide for a multi-ball super-roulette gaming system and method.

The aforementioned aspects and other objectives and advantages can now be achieved as described herein. A video based multi-ball super roulette gaming system is disclosed herein. A main/primary roulette wheel includes a number of numbered and colored ball pockets with betting marks on a betting layout and a circular runway for rotating multiple graphical game balls within the primary roulette wheel. The game/system permits a player to play multiple balls in order to maximize action and increase the probability of win for the player while enticing the player to wager more as each additional game ball will cost the player one additional betting unit to activate thus enticing the player to wager more which will increase gaming volume for the gaming operator.

Game configurations may include, for example, features such as those disclosed in U.S. patent application Ser. No. 13/031,471,along with other innovative game dynamics such as the bonus wheel becoming active only when maximum bet is played (e.g. A multi-ball roulette 5-ball max game configuration where the bonus game is available or active only when all 5 balls are played).

Also unique to the multi-ball roulette embodiments disclosed herein are new wagers such as, for example, a "parley 5" bet where a player makes an additional wager on the layout that represents All red, All Black, All Even, or All Odd during max play (e.g. 5-ball) and when all 5 balls select similar spots a win would be paid. Such a wager would allow for increased size payouts compared with conventional roulette and is an enticing wager for a casino player.

A multimedia device (e.g., an electronic display device and a speaker) generates animation and/or sound during game play in order to enhance spontaneity and excitement for the player within the video-simulated casino environment. The video based multi-ball gaming system can be a stand-alone machine and/or a community-type gaming configuration. The system also includes an electronic display for displaying the roulette wheel. An input device (e.g., touch screen, roller ball, touch pad, mouse, and push buttons) operably associated with the electronic display can be employed for entering the individual numbers and betting selections by the player.

A number of different embodiments, preferred and alternative, are disclosed herein. For example, in some embodiments, a video roulette gaming system can be implemented, which includes a primary roulette wheel having a one or more or a group of ball pockets with betting marks on a betting layout and a circular runway for rotating multiple graphical game balls within the primary roulette wheel; and one or more or a group of graphical game balls that rotate within the primary roulette wheel, such that the primary roulette wheel permits a player to pay and bet with respect to the game balls in order to maximize a gaming action thereof and increase the probability of win for the player while enticing the player to wager more with each additional graphical game ball and increase gaming volume for an operator of said video roulette gaming system.

In some embodiments, the ball pockets can comprise numbered and/or colored ball pockets. In other embodiments, a bonus roulette wheel can become active when a maximum bet is played. In still other embodiments, a parley betting module can be provided, which permits the player to place via the video roulette gaming system, at least one additional wager with respect to the betting layout, wherein the betting layout represents at least one of the following roulette color formats: all red, all black, all even, or all odd. In still other embodiments, a win is payable with respect to the at least one additional wager when the at least additional wager comprises a maximum bet and during which all graphical game balls select similar spots.

In yet another embodiment, a secondary multiplier bonus wheel can be graphically displayed, which rotates within the vicinity of the primary roulette wheel in order to provide a multiplied potential win to activate the secondary multiplier bonus wheel. Additionally, a bonus spot can be provided with a hole and a path located on the primary roulette wheel for transferring the at least one graphical game ball from the primary roulette wheel to the secondary multiplier bonus wheel when the at least one graphical game ball lands upon the bonus spot of the primary roulette wheel. In still other embodiments, a multimedia device can generate an animation and a sound during rotation of the graphical game ball in the primary roulette wheel in order to enhance spontaneity and excitement for the player within a video-simulated casino environment.

In another embodiment, an electronic display can be provided for displaying the primary roulette wheel and secondary multiplier bonus wheel, and an input device can be operably associated with the electronic display for entering an individual number and a betting selection by the player in the casino environment. In yet other embodiments, the secondary multiplier bonus wheel can be a standard set multiplier and/or a mystery set multiplier.

In yet another embodiment, a video roulette gaming method can be provided, which includes, for example, the steps of displaying a primary roulette wheel having one or more or a group of ball pockets with betting marks on a betting layout and a circular runway for rotating multiple graphical game balls within the primary roulette wheel; and presenting one or more a group of graphical game balls that rotates within the primary roulette wheel, such that the primary roulette wheel permits a player to pay and bet with respect to the game balls in order to maximize a gaming action thereof and increase the probability of win for the player while enticing the player to wager more with each additional graphical game ball and increase gaming volume for an operator of the video roulette gaming system. In some embodiments, the ball pockets can be numbered and/or colored ball pockets. Additionally, in some embodiments, a bonus roulette wheel can become active when a maximum bet is played. In still other embodiments of such a method, a parley betting module can be implemented, which permits the player to place via the video roulette gaming system, at least one additional wager with respect to the betting layout, wherein the betting layout represents at least one of the following roulette color formats: all red, all black, all even, or all odd. In still other embodiments a win is payable with respect to the at least one additional wager when the at least additional wager comprises a maximum bet and during which all graphical game balls select similar spots.

Additionally, in other embodiments, a method can include the steps of displaying a secondary multiplier bonus wheel rotating within the vicinity of the primary roulette wheel in order to provide a multiplied potential win to activate the secondary multiplier bonus wheel; and presenting a bonus spot with a hole and a path located on the primary roulette wheel for transferring the at least one graphical game ball from the primary roulette wheel to the secondary multiplier bonus wheel when the at least one graphical game ball lands upon the bonus spot of the primary roulette wheel. In another embodiment, a step can be provided for generating via a multimedia device, an animation and a sound during rotation of the graphical game ball in the primary roulette wheel in order to enhance spontaneity and excitement for the player within a video-simulated casino environment. In yet another embodiment, steps can be implemented for providing an electronic display for displaying the primary roulette wheel and secondary multiplier bonus wheel; and associating an input device the electronic display to allow an individual number and a betting selection to be input by the player. Additionally, in other embodiments of a method, the secondary multiplier bonus wheel can be a standard set multiplier and/or a mystery set multiplier.

In still another embodiment, a processor-readable medium storing code representing instructions to cause a processor to perform a process for video roulette gaming can be implemented. Such code can comprise code to, for example, display a primary roulette wheel having one or more or a group of ball pockets with betting marks on a betting layout and a circular runway for rotating multiple graphical game balls within the primary roulette wheel; and present one or more or a group of graphical game balls that rotates within the primary roulette wheel, such that the primary roulette wheel permits a player to pay and bet with respect to the game balls in order to maximize a gaming action thereof and increase the probability of win for the player while enticing the player to wager more with each additional graphical game ball and increase gaming volume for an operator of the video roulette gaming system.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION

Figure 1:
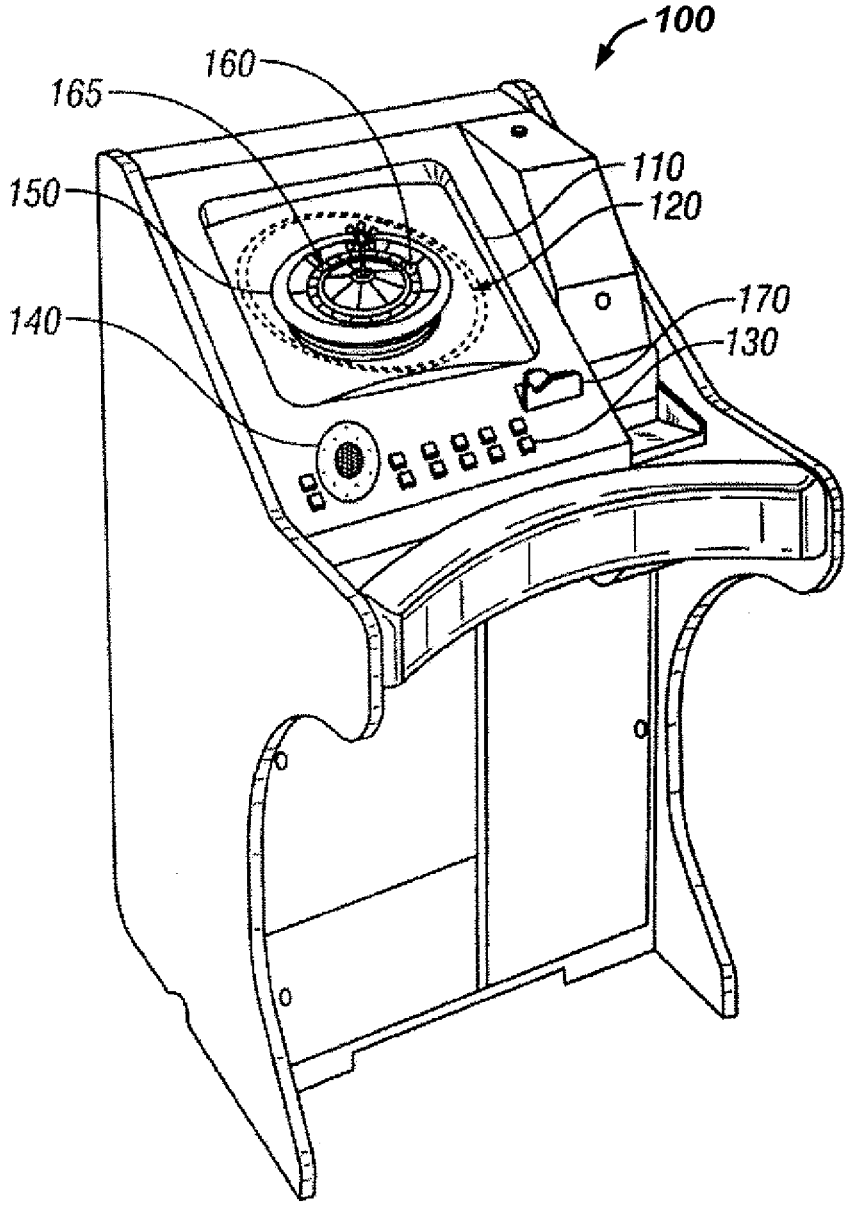
FIG. 1 illustrates a perspective view of a video-based super-roulette gaming system, in accordance with the disclosed embodiments.

The particular values and configurations discussed in these non-limiting examples can be varied and are cited merely to illustrate at least one embodiment and are not intended to limit the scope thereof.

Embodiments disclosed herein are related to the playability and unique game functionality of a multi-ball roulette that when implemented, can add excitement for existing casino roulette players while attracting new players to the video roulette genre. Casino operators can add such an improved video roulette system and method to their slot floor "mix," a game with traditional classic roots that takes full advantage of current technology to create unique game dynamics that are exciting, fresh and new. A casino operator will have options, for example, with respect to game configurations, which offer varying hold percentage values, hit frequencies and other variables important to casino operators. Additionally, the disclosed multi-ball video roulette system and method can be configured with other game features such as those found in U.S. patent application Ser. No. 13/031,471,for example, in order to add to an even further unique and exciting video roulette based slot game.

The embodiments now will be described more fully hereinafter with reference to the accompanying drawings, in which illustrative embodiments of the invention are shown. The embodiments disclosed herein can be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. As used herein, the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As will be appreciated by one of skill in the art, the present invention can be embodied as a method, data processing system, or computer program product. Accordingly, the present invention may take the form of an entirely hardware embodiment, an entirely software embodiment or an embodiment combining software and hardware aspects all generally referred to herein as a "circuit" or "module." Furthermore, the present invention may take the form of a computer program product on a computer-usable storage medium having computer-usable program code embodied in the medium. Any suitable computer readable medium may be utilized including hard disks, USB Flash Drives, DVDs, CD-ROMs, optical storage devices, magnetic storage devices, etc.

Computer program code for carrying out operations of the present invention may be written in an object oriented programming language (e.g., Java, C++, etc.) The computer program code, however, for carrying out operations of the present invention may also be written in conventional procedural programming languages, such as the "C" programming language or in a visually oriented programming environment, such as, for example, VisualBasic.

The program code may execute entirely on the user's computer, partly on the user's computer, as a stand-alone software package, partly on the user's computer and partly on a remote computer or entirely on the remote computer. In the latter scenario, the remote computer may be connected to a user's computer through a local area network (LAN) or a wide area network (WAN), wireless data network e.g., WiFi, Wimax, 802.xx, and cellular network or the connection may be made to an external computer via most third party supported networks (for example, through the Internet using an Internet Service Provider).

The disclosed embodiments are described in part below with reference to flowchart illustrations and/or block diagrams of methods, systems, computer program products and data structures according to embodiments of the invention. It will be understood that each block of the illustrations, and combinations of blocks, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the block or blocks.

These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the block or blocks.

FIG. 1 illustrates a perspective view of a video-based multi-ball gaming system 100, which can be implemented in accordance with the disclosed embodiments. It can be appreciated that the particular embodiment shown in FIG. 1 represents only one possible embodiment. That is, the system 100 is shown in the context of a kiosk type structure, but can also be implemented in, for example, a slot machine type structure or other appropriate casino-type gaming apparatus. The multi-ball gaming system 100 can be employed in a wide range of casino environments in order to permit an operator to offer an exciting roulette game with increased/changeable house advantage values, hit frequency and volatility. The video-based gaming system 100 can be a stand-alone machine and/or a community type gaming machine having the potential and technology to provide enhanced volatility, creating a more exciting experience for a player or multiple players in a casino environment, depending upon design considerations.

Note that the term "casino" can be defined as a facility that houses and accommodates certain types of gambling activities in environments such as, hotels, restaurants, retail shopping, cruise ships and other tourist attractions. A typical casino is a facility that houses and accommodates certain types of gambling activities. Casinos are most commonly built near or combined with hotels, restaurants, retail shopping, cruise ships and other tourist attractions. Some casinos are known for hosting live entertainment events, such as stand-up comedy, concerts, and sporting events.

The gaming system 100 can include, for example, an electronic display 110, one or more input devices 130, a multimedia device 140, and a payment terminal 170. Gaming system 100 can also include a touch screen input 120 that allows a player to touch the electronic display 110 to enter and select data with respect to the graphical image or images displayed via the electronic display 110. The gaming system 100 disclosed herein may be typically implemented in the context of a data-processing system, such as, a gaming kiosk, a personnel computer and/or a laptop that includes, for example, a central processor, a main memory, an input/output controller, the input device(s) 130, a mass storage (e.g., a hard disk), and a USB (Universal Serial Bus) peripheral connection.

The input device(s) 130 can be devices such as, for example, a touch screen, roller ball, touch pad, mouse, and/or push buttons operably associated with the electronic display 110 for entering the individual number and betting selections. As illustrated, the various components of the gaming system 100 can communicate electronically through a system bus or similar architecture. The system bus may be, for example, a subsystem that transfers data between, for example, computer components within the gaming system 100 or to and from other data-processing devices, components, computers, etc.

The electronic display 110 of the gaming system 100 can graphically display a video-based roulette wheel 150 that is incorporated with realistic simulation of multiple game balls 160. The electronic display 110 associated with the gaming system 100, which is preferably a graphical user interface (GUI), can serve to display results of the roulette game, whereupon the player may supply additional inputs and/or terminate a particular session. Note that the primary techniques for enhancing the realistic movement of one or more graphically displayed game balls 160 can be separately implemented in the gaming system 100. The roulette wheel 150 can be, for example, in some embodiments, a pre-recorded graphical simulation over which the graphically displayed game balls 160 rotate at a constant rate. In such a gaming system 100, the processing can be basically limited by substantially simplifying the hardware and software requirements in the casino setting.

The graphically displayed roulette wheel 150 can include graphical representations of, for example, a number of ball pockets and, for example, a circular runway 165 for rotating one or more graphically displayed game balls such as the game ball 160 within the graphically displayed roulette wheel 150. A player can in some scenarios select wagers and launch multiple game balls 160 (e.g., up to 5 balls per chance) into the roulette wheel 150 in order to increase the probability of win while increasing gaming volume based on the nature of the wager. The roulette game of the system 100 can be also be implemented via various other representations such as an electrical, a mechanical, an electro-mechanical, and/or a video representation of the roulette wheel 150. The payment terminal 170 can be, for example, a coin acceptor, bill/ticket acceptor and/or another type of terminal for receiving payments. Terminal 170 can be configured, for example, to accept cash payments and similar currency, and/or credit cards, debit cards, and the like. Thus, a player can access the gaming system 100 by inserting coins, paper currency, tokens, slot tickets, a debit card, a credit card, a smart card or the like into the terminal 170 of the gaming system 100.

The gaming system 100 described herein is intended as an example, and not as an architectural limitation with respect to particular embodiments. Such embodiments, however, are not limited to any particular application or any particular computing or data-processing environment. Instead, those skilled in the art will appreciate that the disclosed system and method may be advantageously applied to a variety of system and application software. Moreover, the present invention may be embodied on a variety of different computing platforms, including Macintosh, UNIX, LINUX, and the like. Gaming system 100 can in some embodiments be embodied in a hand held portable device such as a Smartphone, table computer, PDA (Personal Digital Assistant) and so forth.

Figure 2:
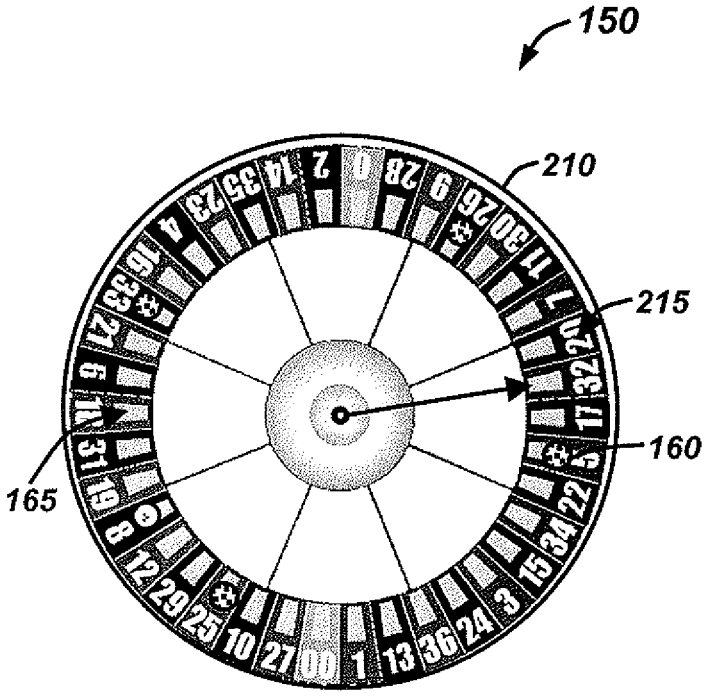
FIG. 2 illustrates a top view of a roulette wheel with multiple balls, in accordance with the disclosed embodiments.

FIG. 2 illustrates a top view of the graphically displayed roulette wheel 150 of FIG. 1 having multiple graphically displayed roulette balls 160, in accordance with the disclosed embodiments. The graphically displayed roulette wheel 150 can include, in some embodiments, a main/primary video roulette wheel 210 having one or more numbered pockets 215 with betting mark located around its periphery. The numbers of each pocket 215 in the primary roulette wheel 210 can be typically displayed with a color such as, a black or red color based on the background on which the number is marked. Each pocket 215 in the primary wheel 210 can be formed by a divider and referred to by a corresponding field. For example, the "0" pocket is aligned with the "0" field. The primary roulette wheel 210 permits a player to pay and play multiple balls 160 in order to maximize the action and winning probability for the player in the casino. The multiple game balls 160 of the gaming system 100 provide an increased chance of win for the player while enticing the player to wager additional units thus increasing gaming volume for the casino operator.

The circular runway 165 of the primary roulette wheel 210 is continuous and tilted inward from the vertical plane by an angle. The joint between the circular runway 165 and the circular wall of the primary wheel 210 has a curvature radius slightly smaller than the radius of the game ball 160. Such an arrangement brings the game ball 160 running along the outermost circumference of the circular runway 165 in contact with the primary roulette wheel 210. The multimedia device such as, the electronic display device 110 and the speaker 140 generates animation and/or sound in the roulette 100 in order to enhance spontaneity and excitement for the player within the video-simulated casino environment.

The roulette wheel 150 described herein typically depicts an American style roulette wheel design. It is however, the roulette wheel 150 need not be an exact replica of a traditional American style roulette wheel. Other types of roulette wheels such as, for example, a European style roulette wheel can be utilized in the place of suggested, depending upon design considerations. The numbers and/or colors of the pockets 215 in the primary roulette wheel 210 can be arranged in a different manner such as, by introducing more or few numbers and/or by replacing the numbers with a symbol (e.g., a fruit). The roulette wheel 150 can be spun and/or made to appear spin in order to provide visual stimulation and to emphasize the random nature of the number generation in the gaming system 100. The super-roulette gaming system therefore creates added values to the slot floor and an improved game mix to the players by adding an exciting twist within the casino environment.

The multi-ball roulette configurations depicted in FIGS. 1-2 can include a wagering approach based on, for example, a "parley 5" bet where a player makes an additional wager via system 100 on a layout that represents All red, All Black, All Even, or All Odd during max play (e.g. 5-ball) and when all 5 balls select similar spots a win would be paid. Such a wager would allow for increased size payouts compared with conventional roulette and is an enticing wager for a casino player.

Figure 3:
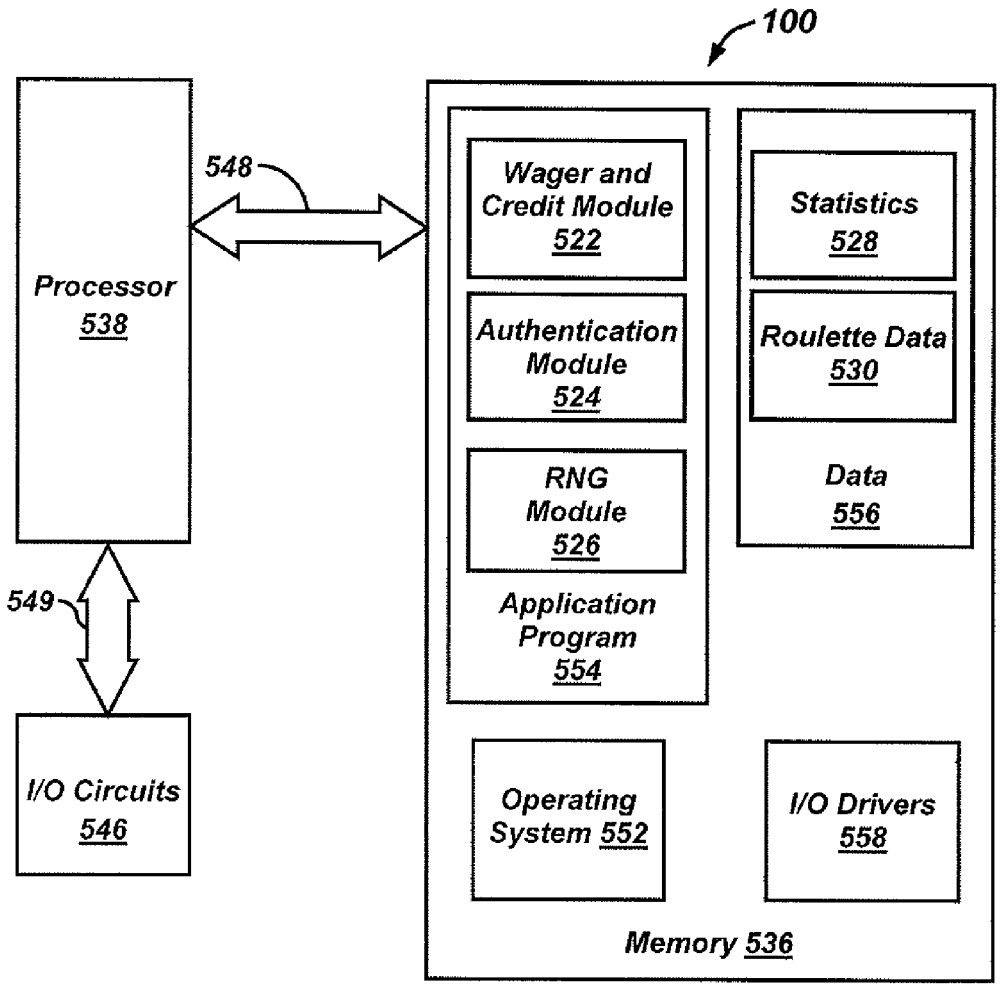
FIG. 3 illustrates an exemplary data processing system or electronic roulette module/database environment that may be included in devices operating in accordance with some embodiments.

Referring now to FIG. 3, an exemplary data processing system 100 or electronic roulette module/database environment that may be included in devices operating in accordance with some embodiments of the present invention will be discussed. Note that the data-processing system 100 disclosed in FIG. 3 can be utilized as or in the context of the electronic roulette system 100 discussed earlier.

As illustrated in FIG. 3, the data processing system 100 can be configured to a processor 538, a memory 536 and input/output circuits 546. The data-processing system 100 may be incorporated in, for example, a personal computer, a portable wireless hand held device (e.g., Smartphone, etc), server, router or the like, and/or may also be implemented in the context of a gaming system such as the roulette gaming system 100 discussed earlier. The processor 538 communicates with the memory 536 via an address/data bus 548 and communicates with the input/output circuits 156 via an address/data bus 549. The input/output circuits 546 can be used to transfer information between the memory 536 and another computer system or a network using, for example, an Internet Protocol (IP) connection and/or wireless or wired communications. These components may be conventional components such as those used in many conventional data processing systems, which may be configured to operate as described herein.

In particular, the processor 538 can be any commercially available or custom microprocessor, microcontroller, digital signal processor or the like. The memory 536 may include any memory devices containing the software and data used to implement the functionality circuits or modules used in accordance with embodiments of the present invention. The memory 536 can include, but is not limited to, the following types of devices: cache, ROM, PROM, EPROM, EEPROM, flash memory, SRAM, DRAM and magnetic disk. In some embodiments of the present invention, the memory 536 may be, for example, a content addressable memory (CAM).

As further illustrated in FIG. 3, the memory 536 may include several categories of software and data used in the data processing system 100: an operating system 552; application programs 554; input/output device drivers 558; and data 556. As will be appreciated by those of skill in the art, the operating system 552 may be any operating system suitable for use with a data processing system, such as, for example, Linux, Windows XP, Mac OS, Unix, etc. The input/output device drivers 558 typically include software routines accessed through the operating system 552 by the application programs 554 to communicate with devices such as the input/output circuits 546 and certain memory 536 components. The application programs 554 are illustrative of the programs that implement the various features of the circuits and modules according to some embodiments of the present invention.

Finally, the data 556 represents static and dynamic data that can be used by the application programs 554, the operating system 552, the input/output device drivers 558, and other software programs that may reside in the memory 536. As illustrated in the example of FIG. 3, the data 556 may include, for example, statistics 528 and roulette information 530 for use by the circuits and modules of the application program(s) 554 according to some embodiments of the present invention as discussed further herein. The event information, for example, may include data associated with a particular event. Statistics 528 may include, for example, not only statistical information related to a particular gaming or a group of games, but also broader statistics, such as, for example, roulette gaming history and scores.

In the embodiment shown in FIG. 3, applications program(s) 554 can include, for example, a wagering and credit module 522, a security or authentication module 524, an RNG module 526, and so forth. While the present invention is illustrated with reference to the wagering and credit module 526, the authentication module 524 and the RNG module 522 being application program(s) in FIG. 3, as will be appreciated by those of skill in the art, other configurations fall within the scope of the present invention. For example, rather than being application program(s) 554, these modules may also be incorporated into the operating system 552 or other such logical division of the data processing system 100.

Furthermore, while the modules 522, 524, and 526 are illustrated in a single data processing system, as will be appreciated by those of skill in the art, such functionality may be distributed across one or more data processing systems. Thus, the present invention should not be construed as limited to the configuration illustrated in FIG. 3, but may be provided by other arrangements and/or divisions of functions between data processing systems. For example, although FIG. 3 is illustrated as having various circuits/modules, one or more of these circuits may be combined without departing from the scope of the present invention.

As utilized herein, the term "module" can refer to a collection or routines (and/or subroutines) and/or data structures that performs a particular task or implements a particular abstract data type. Modules usually include two parts: an interface, which lists the constants, data types, variables, and routines that can be accessed by other modules or routines, and an implementation, which is typically, but not always, private (accessible only to the module) and which contains the source code that actually implements the routines in the module. The term "module" may also refer to a self-contained component that can provide a complete function to a system and can be interchanged with other modules that perform similar functions.

Figure 4:
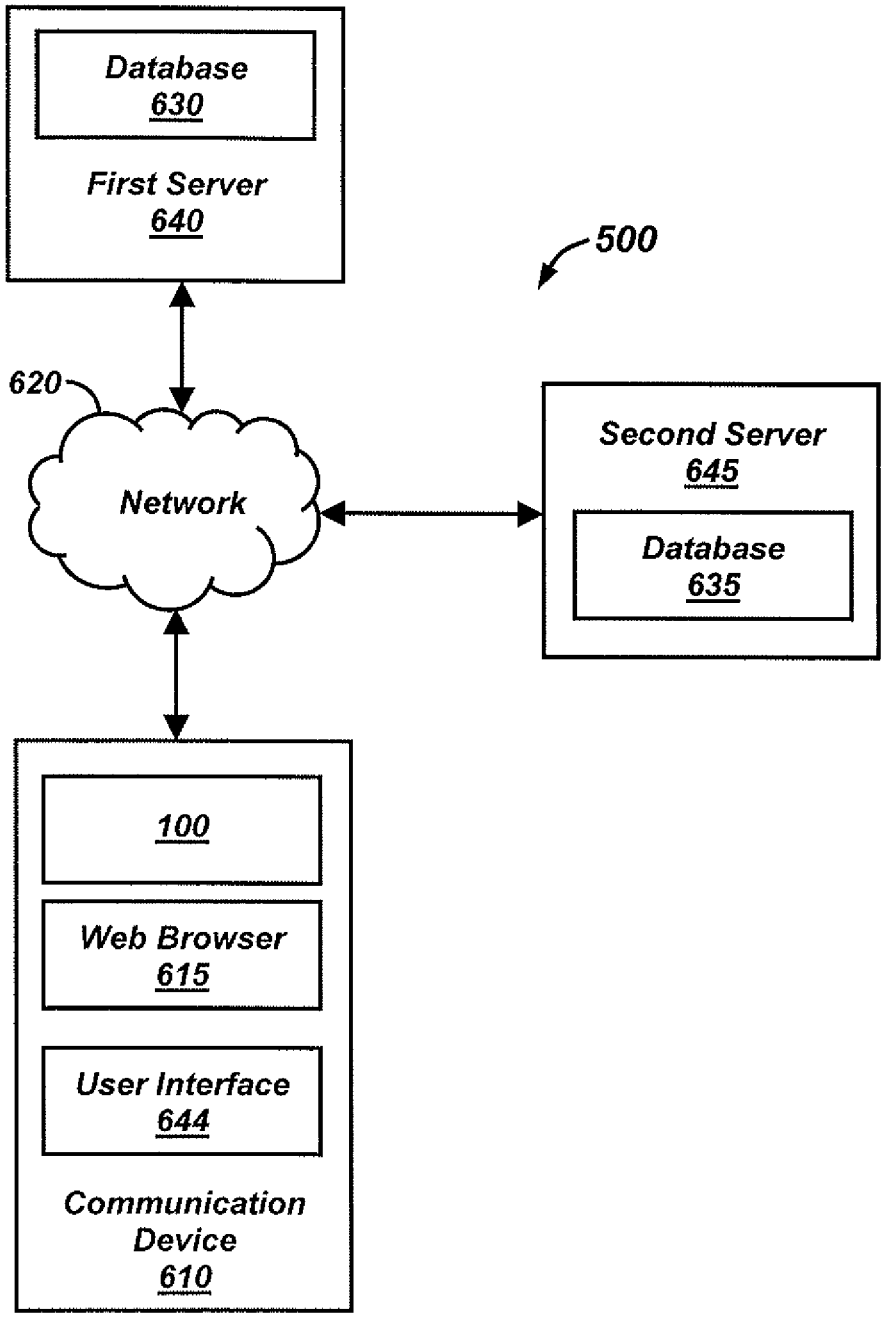
FIG. 4 illustrates an exemplary environment depicting operations and devices according to some embodiments.

Referring now to FIG. 4, an exemplary environment 600 for operations and devices according to some embodiments will be discussed. As illustrated in FIG. 4, the environment 600 may include a communications/computing device 610, a data communications network 620, a first server 640, a second server 645 and/or additional servers not shown herein. It can be appreciated that additional servers may be utilized with respect to network 620. It can also be appreciated that in some embodiments, only a single server, such as server 640 may be required. In general, the communications device 610 allows a user of the communications device 610 to view a graphically displayed roulette game via, for example, the user interface 644 and/or a Web browser 615 and also interactively engage in an electronic "super roulette" game as described herein utilizing bi-directional communications of the remote device 610 with one or more servers 640, 645, etc. over the data communications network 620.

As illustrated, the communications device 610 illustrated in FIG. 4 may include the system 100. For example, the application program(s) 554 discussed with respect to FIG. 4 could be included as part of the system 100 of the communications device 610. The communications device 610 may be, for example, a laptop computer, a desktop computer, a personal data assistant (PDA), Smartphone, a web capable mobile terminal or any device capable of communicating with the network 620. The communications device 610 may also simply be a gaming device such as a casino based electronic roulette gaming device.

The communications device 610 may include, for example, user interface 644, which may be used to interactively engage in an electronic "super roulette" game according to some embodiments of the present invention, and web browser 615, which may be accessed through the user interface 644, according to some embodiments of the present invention. As discussed above, the system 100 may be configured to permit a user to engage in the disclosed electronic "super roulette" game via the communications device 610. The first server 640 may include a database 630 and the second server 645 may include a database 635.

The communications device 610 may communicate over the network 620, for example, the Internet, through a wireless communications link, an Ethernet connection, a telephone line, a digital subscriber link (DSL), a broadband cable link, other wireless links, etc. The first and second servers 640 and 645 may also communicate over the network 620. Thus, the network 620 may convey data between the communications device 610 and the first and second servers 640 and 645. The network 620 can be, for example, a wireless communications network, such as, for example, a cellular communications network or 802.11/WiFi network. The network 620 can also be a client-server network. The remote computing device 610 can be for example, a desktop computer, a laptop computer, a set-top box, or a portable wireless handheld devices such as a Smartphone and/or PDA. The remote computing device 610 can also be, for example, a device such as an iPad type computing device.

Figure 5:
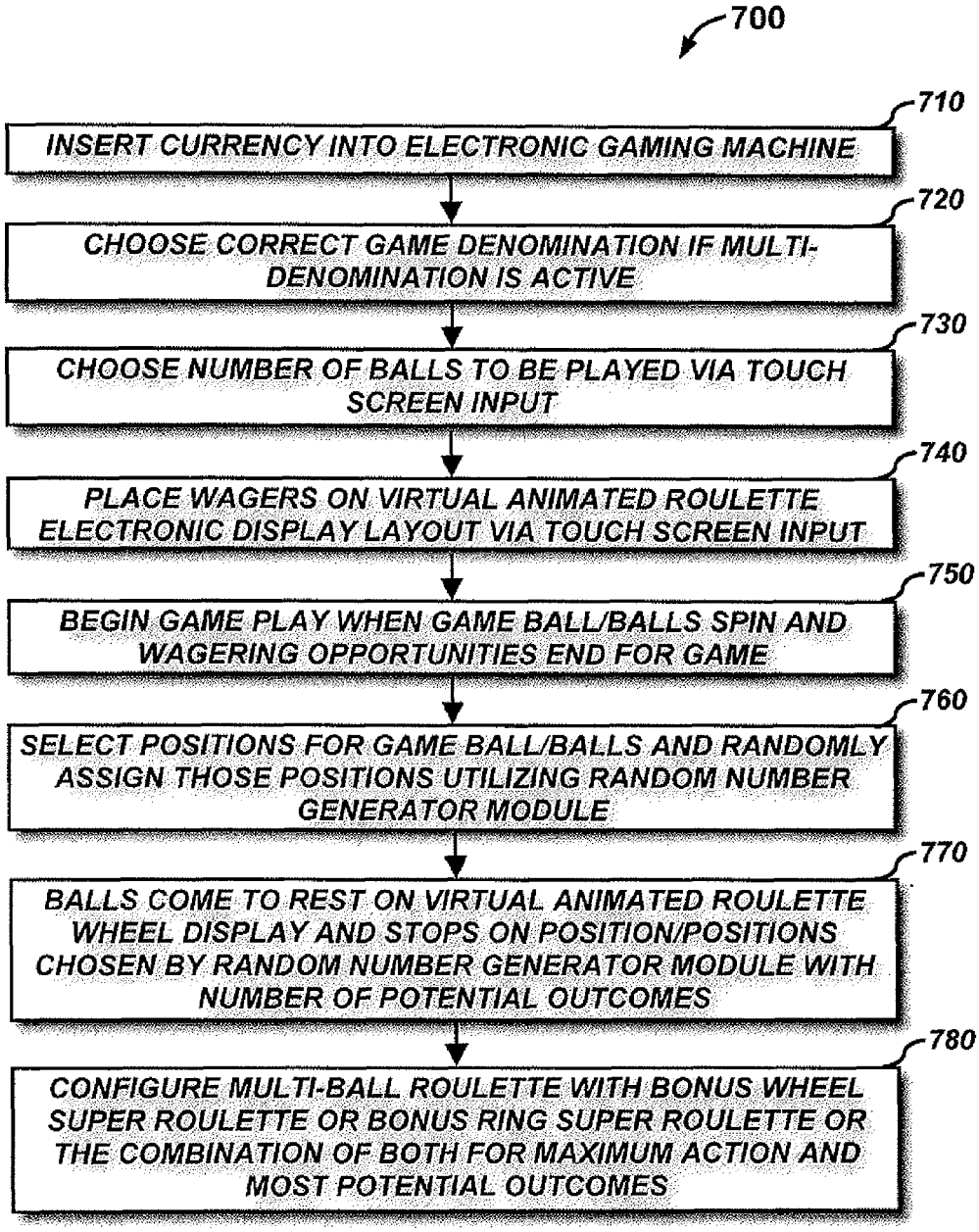
FIG. 5 illustrates a high-level flowchart of operations illustrating logical operational steps of method for playing the video-based super-roulette gaming system, in accordance with the disclosed embodiments.

FIG. 5 illustrate a high-level flowchart of operations illustrating logical operational steps of a method 700 for playing the video-based super-roulette gaming system 100, in accordance with the disclosed embodiments. Note that the method 700 can be implemented in the context of a computer-useable medium that contains a program product, including, for example, a module or group of modules 522, 524, and 526. Note that in FIGS. 1-6, identical or similar blocks are generally indicated by identical reference numerals. A player can insert currency into the payment terminal 170 associated with the electronic gaming system 100, as illustrated at block 710. Next, a correct game denomination (if multi-denomination is active) can be selected by the player, as indicated at block 720. The number of balls 160 to be played can be chosen by the player via the touch screen input 120 (e.g., Roulette balls 1-5 or A-E), as shown at block 730. For example, in a stand-alone configuration (i.e., one player/betting station to one machine/roulette wheel) only the balls selected to be played may actually play and in a community configuration (many players/betting stations to one machine/roulette wheel) all balls will play regardless if wagers are placed on them or not.

Thereafter, as shown at block 740, wagers can be placed on the virtual animated roulette electronic display 110 via the touch screen input 120. The wagers correlate to the selected game ball, for example, the player chooses ball "A" or ball "1" and then places wagers on the virtual animated roulette electronic display 110 via the touch screen input 120 for that game ball, the player then chooses ball "B" or ball "2" and places wagers on the virtual animated roulette electronic display 110 via the touch screen input 120 and so on. The game play can be started when the game ball/balls 160 spin and wagering opportunities end for the game, as illustrated at block 750. For example, in a stand-alone configuration the game play begins when the player presses the "Spin" or "Start" button and in a community configuration the game play begins when a count-down timer reaches zero "0". The count-down timer is viewable at all times on individual betting stations and also displayed on the game's main center display.

The game software's random number generator module 526 selects positions for the game ball/balls 160 and randomly assigns those positions, as indicated at block 760. Next, the balls 160 come to rest on animated roulette electronic display 110 and stops on the position/positions chosen by the random number generator module 526 with a number of potential outcomes, as shown at block 770. The potential outcomes can be for example, If there are no wagers placed on the layout representing or matching the ball/balls resting position/positions then the game ends, the next game begins and wagering resumes. If there are wagers on the layout and matches of the game ball/balls resting position/positions the game's pay table is referenced and all winners are paid. The winning credits can be added to the players betting station's credit meter or the game ends or the next game begins as wagering resumes.

Figure 6:
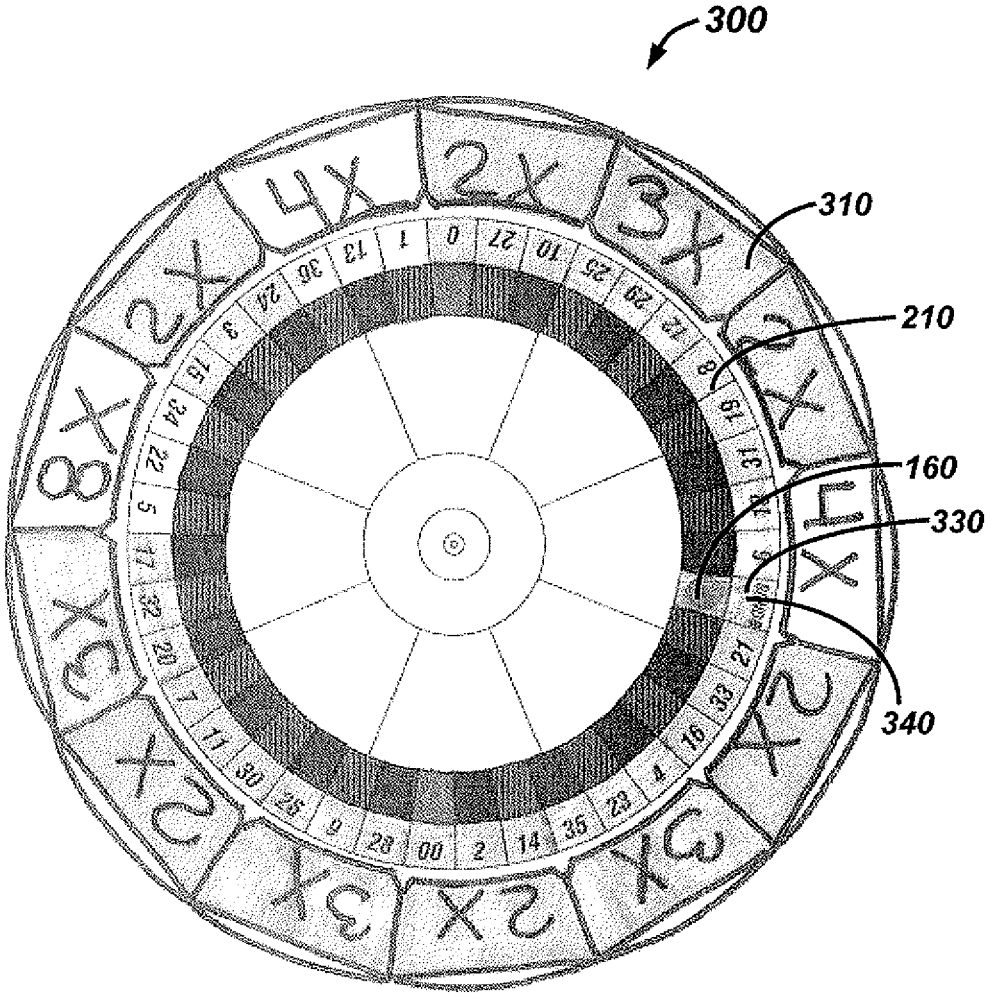
FIG. 6 illustrates a top view of a super ring bonus roulette wheel, in accordance with the disclosed embodiments.

The multi-ball roulette system 100 may be configured with the bonus wheel super roulette or the bonus ring super roulette as shown in FIG. 6 or the combination of both for maximum action and most potential outcomes, as indicated at block 780. If the multi-ball roulette system 100 is configured with bonus wheel super roulette a third potential outcome can be created for example, the game ball 160 comes to rest on a bonus position which activates the bonus wheel super roulette and the secondary wheel is played and the players with active wagers on that particular ball will participate in the bonus game, as shown in FIGS. 6-7.

FIG. 6 illustrate a top view of the super ring bonus roulette wheel 310, in accordance with the disclosed embodiments. The roulette wheel 150 optionally includes the secondary multiplier bonus wheel 310 rotating within the vicinity of the primary roulette wheel 210 in order to provide multiplied potential win for a player(s). The primary roulette wheel 210 includes a bonus spot 330 with a hole and a path 340 in order to provide bonus and/or jackpot to the player when a selected game ball 160 is landed upon the bonus spot 330 and transferred to the bonus wheel 310 via the hole 340. Note that the super ring bonus wheel 310 is an animated wheel which is visible around and outside the circumference of the original roulette wheel 150.

The bonus wheel 310 of the gaming system 100 can be a standard/mystery set multiplier based on the operator preferences. For example, at $22^{nd}$ position on the primary wheel 210, the player can have a chance to win on the bonus wheel 310. If the game ball 160 landed upon the bonus spot 330 of the primary wheel 210 and transferred to the bonus wheel 310, then the player can be awarded with multiple bonuses such as, 2× to 8× multiple bonus wagers in the casino gaming. The secondary multiplier bonus wheel 310 of the roulette wheel 150 can also act as the mystery multiplier based on the operator preferences. A pay table 900 as shown in FIG. 7 can be modified to display a bonus wheel payout (e.g., a credit/bonus payout) and provide a bet pay with respect the players in the casino. The pay table 900 provides a straight-up single number bet pay of 34:1 ratio by redistributing a new held coin-out via the bonus wheel payouts. Note that the system 100 permits the player to play the roulette with or without the secondary multiplier bonus wheel 310. Without the secondary bonus wheel 310, the player can play the roulette by selecting one ball roulette or by increasing the wager play to multiple balls 160 (unto 5 balls) for maximum action and "more ways to win".

Figure 7:
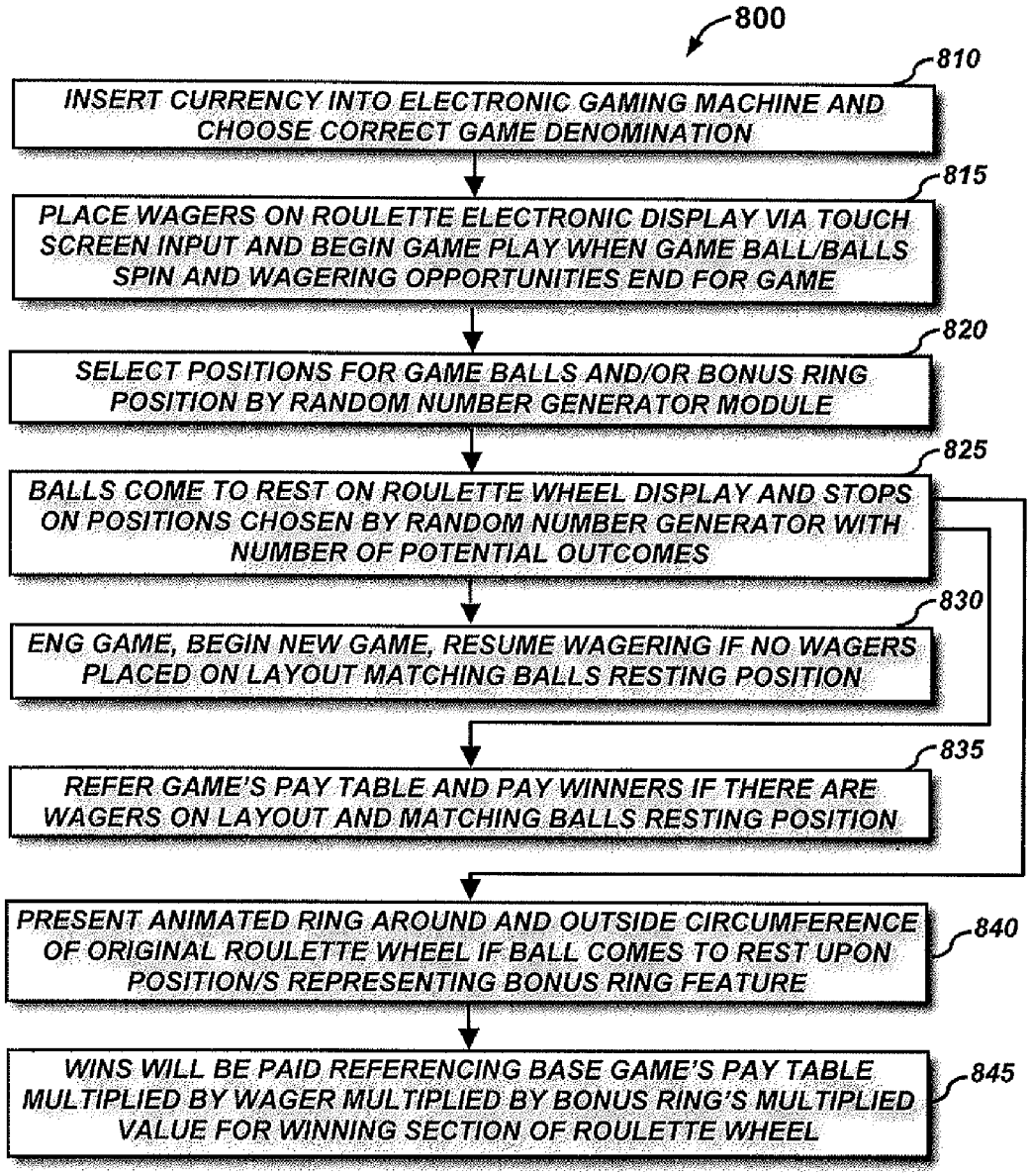
FIG. 7 illustrates a high-level flow chart of operations illustrating logical operational steps of a method for the video-based super ring bonus roulette wheel, in accordance with the disclosed embodiments.

FIG. 7 illustrates a high-level flow chart of operations illustrating logical operational steps of a method 800 for the video-based super ring bonus roulette wheel 310, in accordance with the disclosed embodiments. Note that the method 800 can be implemented in the context of a computer-useable medium that contains a program product, including, for example, a module or group of modules 522, 524, and 526. A player can insert currency into the payment terminal 170 associated with the electronic gaming system 100 and a correct game denomination (if multi-denomination is active) can be selected by the player, as indicated at block 810.

Thereafter, as shown at block 815, wagers can be placed on the virtual animated roulette electronic display 110 via the touch screen input 120 and the game play can be started when the game ball/balls 160 spin and wagering opportunities end for the game. For example, in the stand-alone (one player/betting station to one machine/roulette wheel) configuration game, play begins when the player presses the "Spin" or "Start" button and in a community configuration, (many players/betting stations to one machine/roulette wheel) game play begins when a count-down timer reaches zero "0". Note that the count-down timer is viewable at all times on individual betting stations and also can be displayed on the video-based electronic display 110. Next, the random number generator module 526 selects a position for the game ball 160 from a selection consisting from 1-36 red and black traditional roulette positions, 0 and 00 (or just 0 depending on game configuration) and bonus ring position, as illustrated at block 820.

Figure 8:
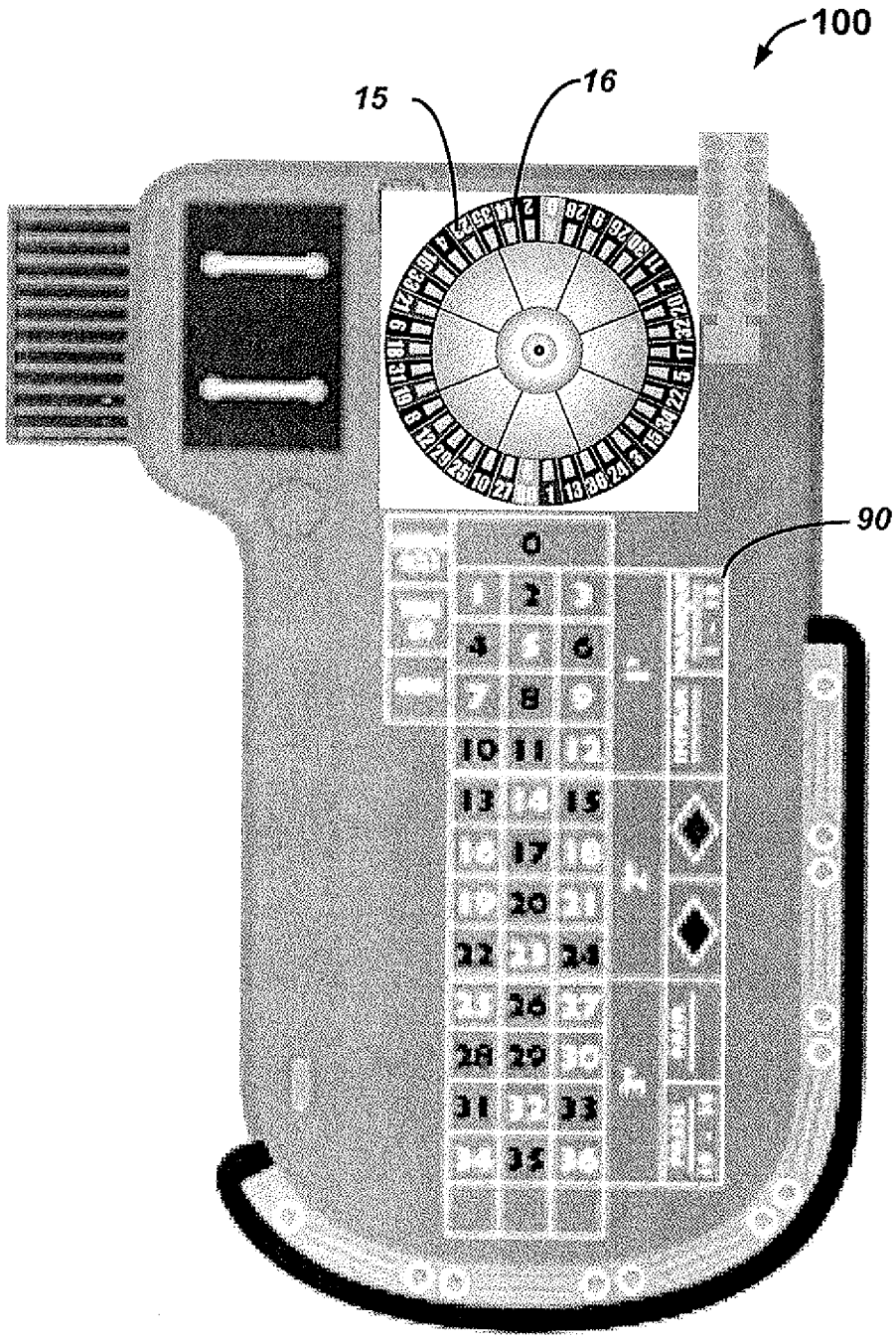
FIG. 8 illustrates a pictorial diagram of a graphical roulette video table that can be displayed in the context of the video-based rouletting gaming system described herein, in accordance with an alternative embodiment.

FIG. 8 illustrates a pictorial diagram of the graphical roulette video table 900 that can be displayed in the context of the video-based rouletting gaming system 100 described herein, in accordance with an alternative embodiment. The numbers on the wheel 150 are displayed in a regular form on the table 900. The table 900 can be covered with a layout 920 with boxes 910 for the numbers 1 through 36 arranged in three columns and twelve rows. At the end of the portion of the layout 920, above the numbers 1, 2, and 3, are boxes for 0 and 00. Each of the numbers 1 through 36 is surrounded by either a red or black oval or rectangle. The 0 and 00 may have green backgrounds. The rectangular grid, with the box 910 for each number, can be employed for wagers called "inside bets." Outside the numbered boxes are several other boxes for "outside bets," encompassing up to 18 numbers at a time. The wheel 150 has 38 numbered slots, each with the same colored background as the corresponding number on the table layout 920.

Figure 9:
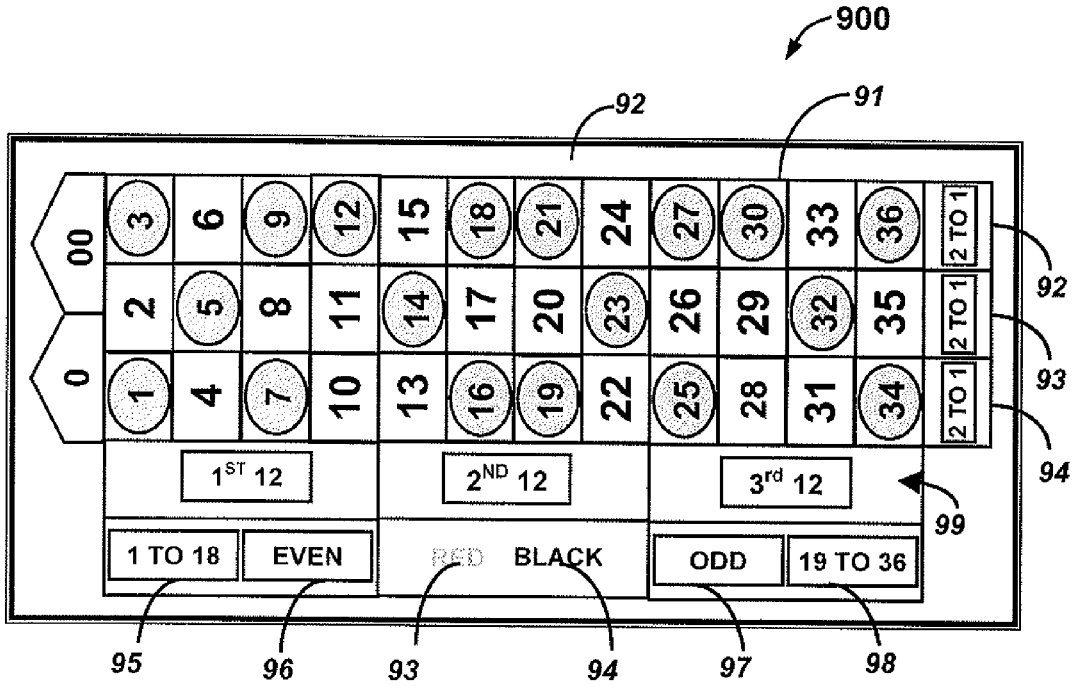
FIG. 9 Illustrates a pictorial diagram of a graphical roulette video table that can be displayed in the context of the video-based rouletting gaming system described herein, in accordance with an alternative embodiment.
Figure 10:
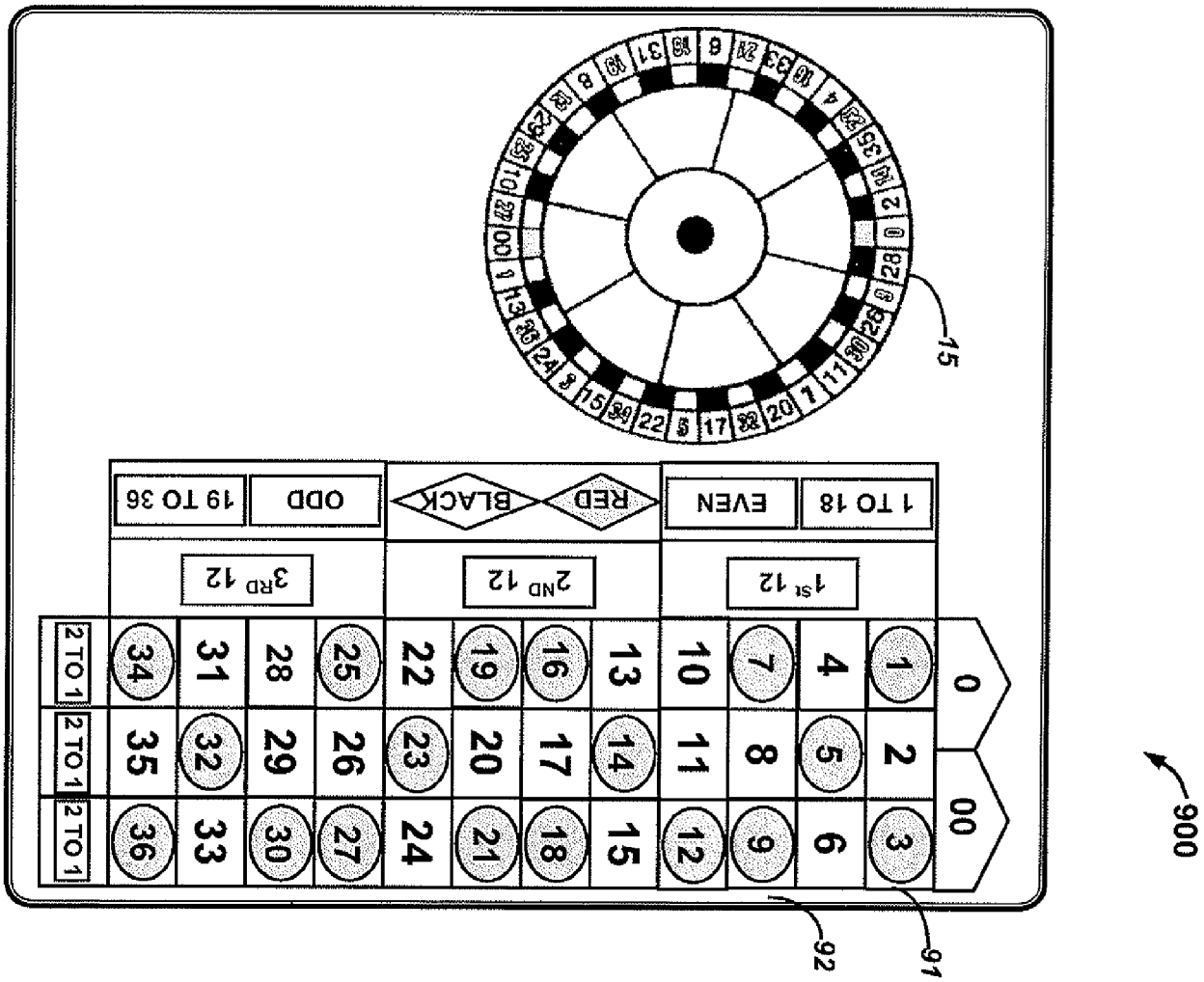
FIG. 10 illustrates a pictorial diagram of a graphical roulette video table that can be displayed in the context of the video-based rouletting gaming system described herein, in accordance with an alternative embodiment.

FIGS. 9-10 illustrate a pictorial diagram of the graphical roulette video table 900 that can be displayed in the context of the video-based rouletting gaming system 100 described herein, in accordance with an alternative embodiment. The table 900 includes 18 numbers with red backgrounds and 18 with black backgrounds for a red or black bet. The roulette table 900 may include betting areas for individual numbers "1 through 36", red 930, black 940, odd numbers 446, even numbers 960, numbers between "1 to 18" 950, numbers between "19 to 36" 980, numbers between "1 to 12", "13 to 24", "25 to 36" as indicated by arrow 990, numbers in first row 925, second row 935, or numbers in third row 945.

A bet on the red 930 pays off if the ball stops in the slot by any of the 18 red numbers and a bet on black 940 pays off if the ball lands on any of the black numbers. The player can also bet either one of the 18 odd numbers 446 (1, 3, 5, and so forth) or one of the 18 even numbers 960 (2, 4, 6, and so forth) for an odd or even bet. Also for even money, a bet on whether the ball 160 can stop on any of the first 18 numbers or any of the last 18 numbers. The boxes 0 and 00 are neither red nor black, neither odd nor even, neither part of the first 18 nor the last 18. If the ball lands on 0 or 00, all even-money bets and outside bets lose.

The ball 160 spins around the roulette wheel 150 and comes to rest on the virtual animated roulette wheel 150 and stops on the position chosen by the random number generator module 526 with a number of potential outcomes, as indicated at block 825. If there are no wagers placed on the layout representing or matching the resting position of the ball 160 the game ends, the next game begins and wagering resumes, as depicted at block 830. If there are wagers on the layout and matching the resting position game ball 160, the game's pay table 900 is referenced and all winners can be paid, as indicated at block 835. For example, the pays can be multiplied by assigned bonus ring multiplier value if won during the bonus ring re-spin feature. The winning credits can be added to the players betting station's credit meter. The game ends and the next game begins as wagering resumes.

If the game ball 160 comes to rest upon position/s representing the bonus spot 330 then the animated wheel 310 is visible around and outside the circumference of the original roulette wheel 150, as illustrated at block 840. The bonus ring's visible multiplier values will serve to segment the original roulette wheel 150. The bonus ring wheel 310 may divide the original roulette wheel 150 in half or segment up to as many positions as the wheel contains. The bonus wheel 310 then spins around the original roulette wheel 150 and comes to rest assigning a multiplied value to each position of the original roulette wheel 150. The bonus re-spin then takes place as the animated game ball 160 spins a second time. Such an approach repeats itself until there are no payable wins remaining.

The wins can be paid referencing the base game's pay table 900 multiplied by the wager multiplied by the bonus ring's multiplied value for the winning section of the roulette wheel 150, as shown at block 845. The bonus ring position may or may not be available for consecutive game ball spins which will allow or not allow for consecutive bonus ring possibilities during the same game depending on game configuration. If the bonus ring position is configured to be available for consecutive selections and the random number generator module 526 selected the bonus ring consecutively, the prior multiplied values can lock in place and be multiplied by the second bonus ring's selection. For example, a player A bets $1 on number 36 and base pay table may be 25 to 1.

The random number generator module 526 can automatically select the bonus ring feature which activates and spins the roulette wheel 150 assigning the number 36 to a 2× multiplier (e.g., player A can now potentially win $50 if the random number generator module 526 selects number 36). The game ball 160 spins the second time and the random number generator module 526 again automatically selects the bonus ring feature. The previous multiplied values are locked in and the bonus ring feature again assigns the number 36 to a 4× multiplier (player A potentially wins $200; $25×2×4) . The game ball spins a third time, the random number generator module 526 automatically selects number 36 and player A wins $200. The multi-ball roulette system 100 may be configured with the bonus wheel super roulette or the bonus ring super roulette or the combination of both for maximum action and most potential outcomes.

Based on the foregoing, it can be appreciated that a number of different embodiments, preferred and alternative, are disclosed herein. For example, in some embodiments, a video roulette gaming system can be implemented, which includes a primary roulette wheel having one or more a group of ball pockets with betting marks on a betting layout and a circular runway for rotating multiple graphical game balls within the primary roulette wheel; and one or more a group of graphical game balls that rotates within the primary roulette wheel, such that the primary roulette wheel permits a player to pay and bet with respect to the game balls in order to maximize a gaming action thereof and increase a probability of win for the player while enticing the player to wager more with each additional graphical game ball and increase a gaming volume for an operator of said video roulette gaming system.

In some embodiments, the ball pockets can comprise numbered and/or colored ball pockets. In other embodiments, a bonus roulette wheel can become active when a maximum bet is played. In still other embodiments, a parley betting module can be provided, which permits the player to place via the video roulette gaming system, at least one additional wager with respect to the betting layout, wherein the betting layout represents at least one of the following roulette color formats: all read, all black, all even, or all odd. In still other embodiments, a win is payable with respect to the at least one additional wager when the at least additional wager comprises a maximum bet and during which all graphical game balls select similar spots.

In yet another embodiment, a secondary multiplier bonus wheel can be graphically displayed, which rotates within the vicinity of the primary roulette wheel in order to provide a multiplied potential win to activate the secondary multiplier bonus wheel. Additionally, a bonus spot can be provided with a hole and a path located on the primary roulette wheel for transferring the at least one graphical game ball from the primary roulette wheel to the secondary multiplier bonus wheel when the at least one graphical game ball lands upon the bonus spot of the primary roulette wheel. In still other embodiments, a multimedia device can generate an animation and a sound during rotation of the graphical game ball in the primary roulette wheel in order to enhance spontaneity and excitement of the player within a video-simulated casino environment.

In another embodiment, an electronic display can be provided for displaying the primary roulette wheel and secondary multiplier bonus wheel, and an input device can be operably associated with the electronic display for entering an individual number and a betting selection by the player in the casino environment. In yet other embodiments, the secondary multiplier bonus wheel can be a standard set multiplier and/or a mystery set multiplier.

In yet another embodiment, a video roulette gaming method can be provided, which includes, for example, the steps of displaying a primary roulette wheel having one or more a group of ball pockets with betting marks on a betting layout and a circular runway for rotating multiple graphical game balls within the primary roulette wheel; and presenting one or more a group of graphical game balls that rotates within the primary roulette wheel, such that the primary roulette wheel permits a player to pay and bet with respect to the game balls in order to maximize a gaming action thereof and increase a probability of win for the player while enticing the player to wager more with each additional graphical game ball and increase a gaming volume for an operator of the video roulette gaming system. In some embodiments, the ball pockets can be numbered and/or colored ball pockets. Additionally, in some embodiments, a bonus roulette wheel can become active when a maximum bet is played. In still other embodiments of such a method, a parley betting module can be implemented, which permits the player to place via the video roulette gaming system, at least one additional wager with respect to the betting layout, wherein the betting layout represents at least one of the following roulette color formats: all red, all black, all even, or all odd. In still other embodiments a win is payable with respect to the at least one additional wager when the at least additional wager comprises a maximum bet and during which all graphical game balls select similar spots.

Additionally, in other embodiments, a method can include the steps of displaying a secondary multiplier bonus wheel rotating within the vicinity of the primary roulette wheel in order to provide a multiplied potential win to activate the secondary multiplier bonus wheel; and presenting a bonus spot with a hole and a path located on the primary roulette wheel for transferring the at least one graphical game ball from the primary roulette wheel to the secondary multiplier bonus wheel when the at least one graphical game ball lands upon the bonus spot of the primary roulette wheel. In another embodiment, a step can be provided for generating via a multimedia device, an animation and a sound during rotation of the graphical game ball in the primary roulette wheel in order to enhance spontaneity and excitement of the player within a video-simulated casino environment. In yet another embodiment, steps can be implemented for providing an electronic display for displaying the primary roulette wheel and secondary multiplier bonus wheel; and associating an input device the electronic display to allow an individual number and a betting selection to be input by the player. Additionally, in other embodiments of a method, the secondary multiplier bonus wheel can be a standard set multiplier and/or a mystery set multiplier.

In still another embodiment, a processor-readable medium storing code representing instructions to cause a processor to perform a process for video roulette gaming can be implemented. Such code can comprise code to, for example, display a primary roulette wheel having one or more a group of ball pockets with betting marks on a betting layout and a circular runway for rotating multiple graphical game balls within the primary roulette wheel; and present one or more a group of graphical game balls that rotates within the primary roulette wheel, such that the primary roulette wheel permits a player to pay and bet with respect to the game balls in order to maximize a gaming action thereof and increase a probability of win for the player while enticing the player to wager more with each additional graphical game ball and increase a gaming volume for an operator of the video roulette gaming system.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A video roulette gaming system, comprising:

a primary roulette wheel having a plurality of ball pockets with betting marks on a betting layout and a circular runway for rotating multiple graphical game balls within said primary roulette wheel;

a plurality of graphical game balls that rotates within said primary roulette wheel, such that said primary roulette wheel permits a player to pay and bet with respect to said plurality of game balls in order to maximize a gaming action thereof and increase a probability of win for said player while enticing said player to wager more with each additional graphical game ball and increase a gaming volume for an operator of said video roulette gaming system;

a secondary multiplier bonus wheel rotating within the vicinity of said primary roulette wheel in order to provide a multiplied potential win to activate said secondary multiplier bonus wheel; and a bonus spot with a hole and a path located on said primary roulette wheel for transferring at least one graphical game ball from said primary roulette wheel to said secondary multiplier bonus wheel when said at least one graphical game ball lands upon said bonus spot of said primary roulette wheel.

2. The system of claim 1 wherein said plurality of ball pockets comprises numbered and colored ball pockets.

3. The system of claim 1 further comprising a bonus roulette wheel that becomes active when a maximum bet is played.

4. The system of claim 1 further comprising a parley betting module that permits said player to place via said video roulette gaming system, at least one additional wager with respect to said betting layout, wherein said betting layout represents at least one of the following roulette color formats: all read, all black, all even, or all odd.

5. The system of claim 1 wherein a win is payable with respect to at least one additional wager when said at least one additional wager comprises a maximum bet and during which all graphical game balls select similar spots.

6. The system of claim 1 further comprising a multimedia device that generates an animation and a sound during rotation of said graphical game ball in said primary roulette wheel in order to enhance spontaneity and excitement for said player within a video-simulated casino environment.

7. The system of claim 1 further comprising:

an electronic display for displaying said primary roulette wheel and said secondary multiplier bonus wheel; and an input device operably associated with said electronic display for entering an individual number and a betting selection by said player in said casino environment.

8. The system of claim 1 wherein said secondary multiplier bonus wheel comprises a standard set multiplier.

9. The system of claim 1 wherein said secondary multiplier bonus wheel comprises a mystery set multiplier.

10. A method of operating a video roulette gaming device, said method comprising:

displaying, via the video roulette gaming device, a primary roulette wheel having a plurality of ball pockets with betting marks on a betting layout and a circular runway for rotating multiple graphical game balls within said primary roulette wheel;

presenting, via the video roulette gaming device, a plurality of graphical game balls that rotates within said primary roulette wheel, such that said primary roulette wheel permits a player to pay and bet with respect to said plurality of game balls in order to maximize a gaming action thereof and increase a probability of win for said player while enticing said player to wager more for each additional graphical game ball and increase a gaming volume for an operator of said video roulette gaming system;

displaying, via the video roulette gaming device, a secondary multiplier bonus wheel rotating within the vicinity of said primary roulette wheel in order to provide a multiplied potential win to activate said secondary multiplier bonus wheel; and presenting, via the video roulette gaming device, a bonus spot with a hole and a path located on said primary roulette wheel for transferring at least one graphical game ball from said primary roulette wheel to said secondary multiplier bonus wheel when said at least one graphical game ball lands upon said bonus spot of said primary roulette wheel.

11. The method of claim 10 wherein said plurality of ball pockets comprises numbered and colored ball pockets.

12. The method of claim 10 further comprising displaying via said video roulette gaming device, a bonus roulette wheel that becomes active when a maximum bet is played.

13. The method of claim 10 further comprising permitting, via said video roulette gaming device, said player to place via said video roulette gaming device, at least one additional wager with respect to said betting layout, wherein said betting layout represents at least one of the following roulette color formats: all red, all black, all even, or all odd.

14. The method of claim 10 wherein a win is payable with respect to at least one additional wager when said at least one additional wager comprises a maximum bet and during which all graphical game balls select similar spots.

15. The method of claim 10 further comprising generating via said video roulette gaming device, an animation and a sound during rotation of said graphical game ball in said primary roulette wheel in order to enhance spontaneity and excitement of said player within a video-simulated casino environment.

16. The method of claim 10 further comprising:

displaying, via an electronic display of said video roulette gaming device, said primary roulette wheel and secondary multiplier bonus wheel; and allowing, via an input device associated with said electronic display, an individual number and a betting selection to be input by said player.

17. The method of claim 10 wherein said secondary multiplier bonus wheel comprises a standard set multiplier and/or a mystery set multiplier.

18. A non-transitory processor-readable medium storing code representing instructions to cause a processor to perform a process for video roulette gaming via a video roulette video gaming system, said code comprising code to:

display a primary roulette wheel having a plurality of ball pockets with betting marks on a betting layout and a circular runway for rotating multiple graphical game balls within said primary roulette wheel;

present a plurality of graphical game balls that rotates within said primary roulette wheel, such that said primary roulette wheel permits a player to pay and bet with respect to said plurality of game balls in order to maximize a gaming action thereof and increase a probability of win for said player while enticing said player to wager more for each additional graphical game ball and increase gaming volume for an operator of said video roulette gaming system;

display a secondary multiplier bonus wheel rotating within the vicinity of said primary roulette wheel in order to provide a multiplied potential win to activate said secondary multiplier bonus wheel; and present a bonus spot with a hole and a path located on said primary roulette wheel for transferring at least one graphical game ball from said primary roulette wheel to said secondary multiplier bonus wheel when said at least one graphical game ball lands upon said bonus spot of said primary roulette wheel.

19. The non-transitory processor-readable medium of claim 18 wherein said plurality of ball pockets comprises numbered and colored ball pockets.

20. The non-transitory processor-readable medium of claim 18 wherein said code further comprises code to display a bonus roulette wheel that becomes active when a maximum bet is played.

21. The non-transitory processor-readable medium of claim 18 wherein said code further comprises code to permit said player to place via said video roulette gaming device, at least one additional wager with respect to said betting layout, wherein said betting layout represents at least one of the following roulette color formats: all red, all black, all even, or all odd.

22. The non-transitory processor-readable medium of claim 18 wherein a win is payable with respect to at least one additional wager when said at least one additional wager comprises a maximum bet and during which all graphical game balls select similar spots.

23. The non-transitory processor-readable medium of claim 18 wherein said code further comprises code to generate an animation and a sound during rotation of said graphical game ball in said primary roulette wheel in order to enhance spontaneity and excitement of said player within a video-simulated casino environment.

24. The non-transitory processor-readable medium of claim 18 wherein said code further comprises code to:

display said primary roulette wheel and secondary multiplier bonus wheel; and allow an individual number and a betting selection to be input by said player.

25. The non-transitory processor-readable medium of claim 18 wherein said secondary multiplier bonus wheel comprises at least one of a standard set multiplier and a mystery set multiplier.

* * * * *